US011668540B2

(12) United States Patent
Spector et al.

(10) Patent No.: US 11,668,540 B2
(45) Date of Patent: Jun. 6, 2023

(54) HEAT DISSIPATING FIREARM SUPPRESSOR

(71) Applicant: RFPH, LLC

(72) Inventors: David Morris Spector, Missouri City, TX (US); Phillip Eugene Haag, Jr., Rosenberg, TX (US)

(73) Assignee: RFPH, LLC, Stafford, TX (US)

( * ) Notice: Subject to any disclaimer, the term of this patent is extended or adjusted under 35 U.S.C. 154(b) by 48 days.

(21) Appl. No.: 17/091,992

(22) Filed: Nov. 6, 2020

(65) Prior Publication Data

US 2021/0254921 A1 Aug. 19, 2021

Related U.S. Application Data

(60) Provisional application No. 62/961,830, filed on Jan. 16, 2020.

(51) Int. Cl.
*F41A 21/30* (2006.01)

(52) U.S. Cl.
CPC ..... *F41A 21/30* (2013.01)

(58) Field of Classification Search
CPC ..... F41A 21/30–38
USPC ..... 89/14.2–14.4; 181/223
See application file for complete search history.

(56) References Cited

U.S. PATENT DOCUMENTS 3,837,107 A 9/1974 Swaim et al.
D280,655 S 9/1985 Cellini
D285,238 S 8/1986 Cellini
D296,350 S 6/1988 Cellini
5,305,677 A * 4/1994 Kleinguenther ..... F41A 21/36 89/14.3
D435,884 S 1/2001 Dehaan
6,192,612 B1 2/2001 Maier et al.
D585,518 S 1/2009 Brittingham
8,322,266 B2 * 12/2012 Presz, Jr. ..... F41A 21/34 89/14.4
8,453,789 B1 6/2013 Honigmann et al.
8,522,662 B2 * 9/2013 Presz, Jr. ..... F41A 13/08 89/14.3
8,826,793 B2 * 9/2014 Oliver ..... F41A 21/30 89/14.4
8,844,422 B1 * 9/2014 Klett ..... F41A 21/34 89/14.4
8,875,612 B1 11/2014 Klett et al.
(Continued)

OTHER PUBLICATIONS

Israeli Office Action dated Jan. 20, 2021 for Application No. 65544.
(Continued)

*Primary Examiner* — Joshua E Freeman
*Assistant Examiner* — Benjamin S Gomberg
(74) *Attorney, Agent, or Firm* — Patterson + Sheridan, LLP

(57) ABSTRACT

Embodiments described herein relate to a suppressor that includes a unitary structure comprising a body having an interior volume and a cone shaped nozzle disposed at one end of the body, wherein the body includes a plurality of cooling channels spanning a length of the body, and a plurality of internal channels that are formed radially inward of the cooling channels, and both of the plurality of cooling channels and the plurality of internal channels terminating in a faceplate of the body, a central bore is formed from a breech end of the body to the faceplate, and a plurality of baffles surround the central bore.

23 Claims, 5 Drawing Sheets

(56) References Cited

U.S. PATENT DOCUMENTS

| | | | | |
|---|---|---|---|---|
| 9,052,152 | B2 * | 6/2015 | Moss | F41A 21/30 |
| 9,086,248 | B2 * | 7/2015 | Young | F41A 21/30 |
| 9,316,456 | B1 | 4/2016 | Oliver | |
| D761,373 | S | 7/2016 | Lessard | |
| D764,621 | S | 8/2016 | Dueck et al. | |
| D776,226 | S | 1/2017 | Green et al. | |
| D779,621 | S | 2/2017 | Salvador | |
| D792,545 | S | 7/2017 | Green et al. | |
| D810,224 | S | 2/2018 | Lessard | |
| 10,126,084 | B1 * | 11/2018 | Oglesby | F41A 21/30 |
| D839,375 | S | 1/2019 | James | |
| D842,419 | S | 3/2019 | Edminster et al. | |
| 10,222,162 | B2 | 3/2019 | Adamson, Jr. | |
| 10,288,374 | B1 | 5/2019 | Fricke et al. | |
| 10,330,420 | B2 * | 6/2019 | Kunsky | F41A 21/30 |
| D860,372 | S | 9/2019 | Riley | |
| D876,575 | S | 2/2020 | Delgado Acarreta et al. | |
| 10,634,445 | B1 * | 4/2020 | Klett | F41A 21/30 |
| D888,871 | S | 6/2020 | Momaira | |
| 10,677,555 | B2 | 6/2020 | Fricke et al. | |
| 10,690,431 | B2 * | 6/2020 | Washburn, III | F41A 21/30 |
| 10,890,404 | B2 * | 1/2021 | Petersen | F41A 21/30 |
| D910,139 | S | 2/2021 | Chin | |
| 11,125,523 | B2 * | 9/2021 | Petersen | F41A 21/30 |
| 2013/0312592 | A1 | 11/2013 | Storrs et al. | |
| 2015/0184968 | A1 | 7/2015 | Fischer et al. | |
| 2016/0123689 | A1 * | 5/2016 | Maeda | F41A 21/30 89/14.3 |
| 2019/0204038 | A1 | 7/2019 | Conner | |
| 2019/0257607 | A1 | 8/2019 | Dobrinescu | |
| 2019/0285375 | A1 * | 9/2019 | Hartwell | F41A 21/30 |
| 2019/0331449 | A1 | 10/2019 | Marfione | |
| 2019/0376758 | A1 | 12/2019 | Tiziani | |
| 2020/0103194 | A1 | 4/2020 | Oliver | |
| 2020/0173751 | A1 * | 6/2020 | Dome | F41A 21/30 |
| 2021/0254921 | A1 | 8/2021 | Spector et al. | |
| 2021/0404760 | A1 | 12/2021 | Hipp | |
| 2022/0057160 | A1 * | 2/2022 | Johns | F41A 21/30 |

OTHER PUBLICATIONS

Cox, Matthew. "US Special Operators Could Use This New Suppressor That Relies on WWI Technology" Posted: Jan. 22, 2020 [visited: Jan. 5, 2021] Military.com URL:https://www.military.com/daily-news/2020/01/22/us-special-operators-could-use-new-suppressor-relies-wwi-technology.html (Year: 2020).

The Dead District. "New Suppressor That Relies on #WWI Technology" Tweeted: Jan. 23, 2020 [visited: Jan. 5, 2021] Twitter URL: https://twitter.com/TheDeadDistric/status/1220272357039919104 (Year: 2020).

Van Nostrand Company. Operation and Tactical Use of the Lewis Automatic Machine Rifle. Published: 1917 [visited: Jan. 5, 2022] Fenrir.com URL: http://www.fenrir.com/free_stuff/lewis/003.htm (Year: 1917).

* cited by examiner

HEAT DISSIPATING FIREARM SUPPRESSOR

CROSS-REFERENCE TO RELATED APPLICATION

This application claims benefit of U.S. Provisional Patent application Ser. No. 62/961,830, filed Jan. 16, 2020, which is hereby incorporated by reference herein.

BACKGROUND

Field

Embodiments of the disclosure relate generally to a firearm suppressor device which can be used for any type of system where there is an explosive gaseous generation, and sound and/or flash mitigation is an important factor. More particularly, embodiments of the suppressor described herein can be used in firearm applications (hunting, law enforcement, armed conflicts etc.) where sound and/or flash suppression is required.

Description of the Related Art

Firearm suppressors (or silencers) greatly reduce the audible report from a gaseous explosion that occurs when firing a round (i.e., discharging a projectile) from a barrel of a firearm. While mitigating sound, suppressors also mitigate the muzzle flash associated with burning gunpowder exiting the barrel of the firearm during firing. Because suppressors allow the user to operate firearms without the need for hearing protection, they have become very popular for use in military, law enforcement and civilian applications. However, heat absorbed by conventional suppressors during use raises the temperature of the suppressor to levels that may cause burns, which creates a safety risk to a user.

In particular, military applications often require firing multiple rounds in a short time period. For example, belt-fed firearms allow firing hundreds of rounds in a few minutes or less, which elevates the temperature of a suppressor connected to the firearm to 1,000 degrees Fahrenheit, or greater. These elevated temperatures can severely damage or completely destroy conventional suppressors.

Accordingly, what is needed in the art is a suppressor that mitigates heat as well as sound and flash.

SUMMARY

Embodiments described herein relate to a suppressor that includes a unitary structure comprising a body having an interior volume and a cone shaped nozzle disposed at one end of the body, wherein the body includes a plurality of cooling channels spanning a length of the body, and a plurality of internal channels that are formed radially inward of the cooling channels, and both of the plurality of cooling channels and the plurality of internal channels terminating in a faceplate of the body, a central bore is formed from a breech end of the body to the faceplate, and a plurality of baffles surround the central bore.

In another embodiment, a suppressor is disclosed that includes a unitary structure comprising a body having an interior volume and a cone shaped nozzle disposed at one end of the body, wherein the body includes a plurality of cooling channels spanning a length of the body, and a plurality of internal channels that are formed radially inward of the cooling channels, and both of the plurality of cooling channels and the plurality of internal channels terminating in a faceplate of the body, a central bore is formed from a breech end of the body to the faceplate, and a plurality of baffles surrounding the central bore, wherein a portion of the plurality of baffles defines a blast chamber downstream of an expansion chamber, and wherein the blast chamber is bounded by a first baffle and a second baffle.

In another embodiment, a suppressor is disclosed that includes a unitary structure comprising a body having an interior volume and a cone shaped nozzle disposed at one end of the body, wherein the body includes a plurality of cooling channels spanning a length of the body, and a plurality of internal channels that are formed radially inward of the cooling channels, and both of the plurality of cooling channels and the plurality of internal channels terminating in a faceplate of the body, wherein the cone shaped nozzle includes a muzzle chamber at a muzzle end of the unitary body, and wherein the unitary structure incudes a first portion including the muzzle chamber and a second portion including the interior volume, and a volumetric ratio of the interior volume relative to the muzzle chamber is about 85%:15%, a central bore formed from a breech end of the body to the faceplate, and a plurality of baffles surrounding the central bore, wherein a portion of the plurality of baffles defines a blast chamber bounded by a first baffle and a second baffle.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, and may admit to other equally effective embodiments.

FIG. 10 is a front view of the suppressor along lines 10-10 of FIG. 1A.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Figure 1A:
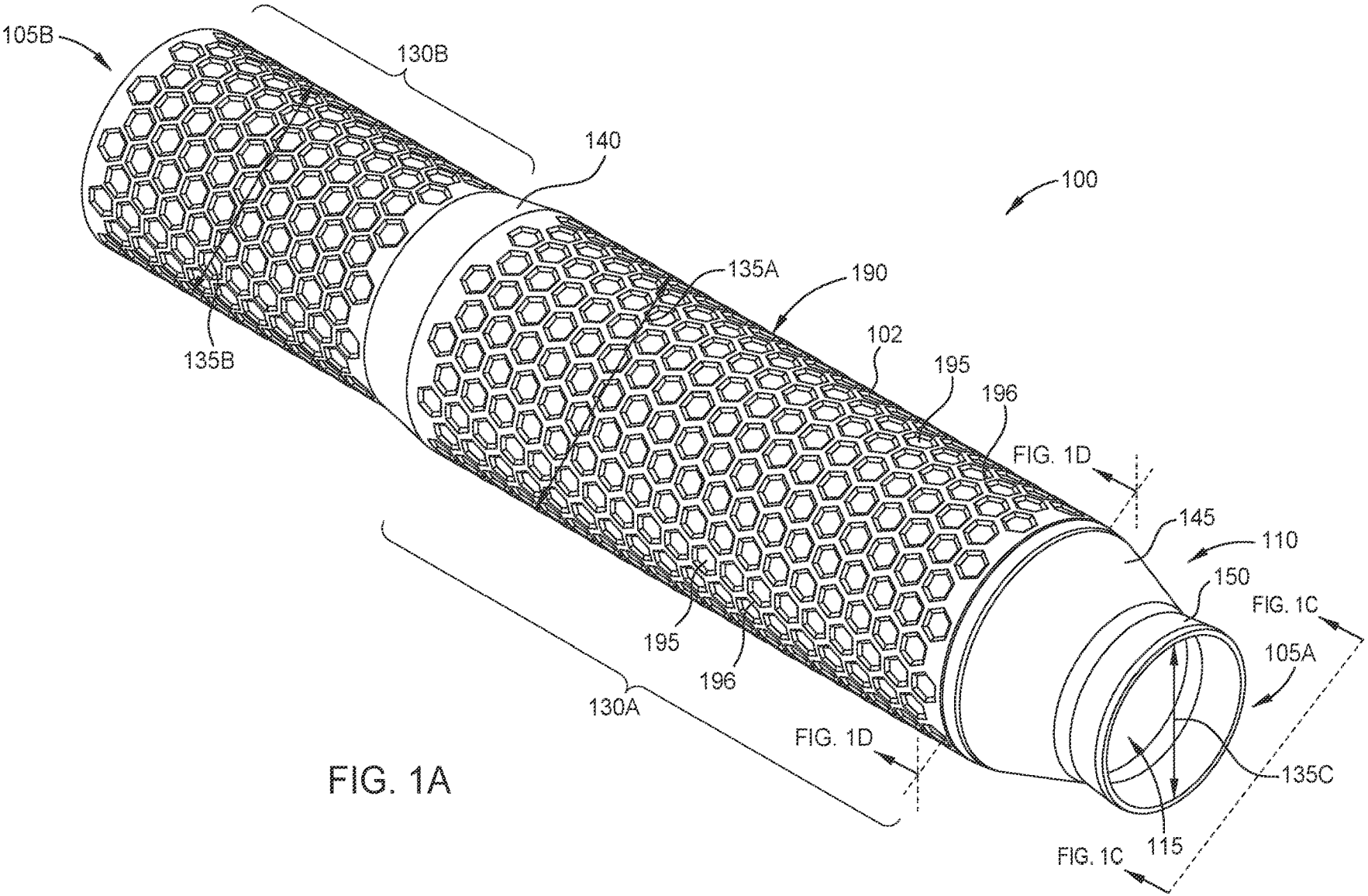
FIG. 1A is an isometric front view of a suppressor according to one embodiment.

Embodiments described herein provide a firearm suppressor that minimizes sound, flash and heat during and/or after use. Although the suppressor as described herein may be used with any type of firearm, the suppressor is specifically designed for semi-automatic firearms or select-fire firearms, for example firearms operating in a full automatic firing mode. Examples of firearms that the suppressor as described herein may be used with include machine guns such as M4A1 style firearms, M-16 style firearms, AR-10 style firearms, belt-fed style firearms, M-240 style firearms as well as other firearms configured to fire repeatedly without reloading after each round is fired.

One drawback of conventional suppressor designs is heat build-up during use. For example, suppressors are heated during the firing of a firearm to temperatures exceeding 1,200 degrees Fahrenheit (F) to 1,500 degrees F., or greater. This creates a safety hazard to humans from burns, melting of base metals used in the construction of the conventional suppressors, damage or weakening of welds (or other joints used in the construction of the conventional suppressors), or other damage that may cause the suppressor to fail. Even after firing has ceased, the conventional suppressors may take hours to cool to a temperature where a user could safely handle the suppressor.

Embodiments of the suppressor as described herein includes unique heat dissipating features which minimizes heat accumulation during use as compared to conventional suppressors. Embodiments of the heat dissipating features described herein also facilitates enhanced cooling after firing as compared to conventional suppressors. In one example, the suppressor as described herein, after sustained firing over a short period of time, may be cooled to a temperature that allows safe handling in about 30 minutes. Additionally, embodiments of the suppressor as described herein includes a construction which provides enhanced structural rigidity and/or lifetime when used with modern select-fire firearms at high firing rates.

Fundamental to the benefits of the suppressor as described herein is the mode of manufacture. Unlike conventional suppressor manufacturing, additive manufacturing (3D printing) allows each layer to fuse together at all points of surface contact, instead of weld points, adding a structural rigidity traditional manufacturers are unable to achieve. Additive manufacturing allows several factors not available in conventional manufacturing methods. For example, additive manufacturing allows design that is not limited by traditional cutting tools. Additive manufacturing also allows for a monolithic suppressor as opposed to multiple components. This increases surface contact between the structural layers, as opposed to a single weld point or a threaded connection. Each layer is monolithic to the next on every contacted surface, which vastly increases structural integrity and overall durability of the suppressor. Thus, the suppressor as described herein is a single (unitary) structure. The terms "single" and/or "unitary" may be defined as having the indivisible character of a unit (i.e. whole or monolithic). The terms "single", "monolithic" and/or "unitary" are differentiated from conventional suppressors that include modular or discrete components that are welded or otherwise joined together.

Materials for the suppressor as described herein include metals adapted for high temperature applications that retain structural properties and strength at elevated temperatures as well as heat dissipating qualities. Examples include nickel (Ni) and alloys thereof. In one example, the suppressor as described herein is made of a nickel alloy comprising greater than 50% Ni by weight percent (weight %). In another example, the suppressor material as described herein consists of 57 weight % Ni and 10 weight % cobalt (Co).

In addition, while traditional suppressors are effectively sealed and limited to exhausting hot gases through a central bore (where a projectile passes through the suppressor), the suppressor as described herein is vented. In particular, the suppressor as described herein is a forward venturi suppressor as all gases are exhausted via an enlarged opening at the muzzle end (through a nozzle and/or a muzzle chamber formed outside of the structural frame) of the suppressor. While the structural frame is effectively sealed, there are multiple channels formed therein that differentiate the construction of the suppressor as described herein when compared to conventional suppressors. Thus, the enlarged opening at the muzzle end, which is integral to the suppressor, allows more volume for gases to be exhausted as compared to conventional suppressors.

Figure 1B:
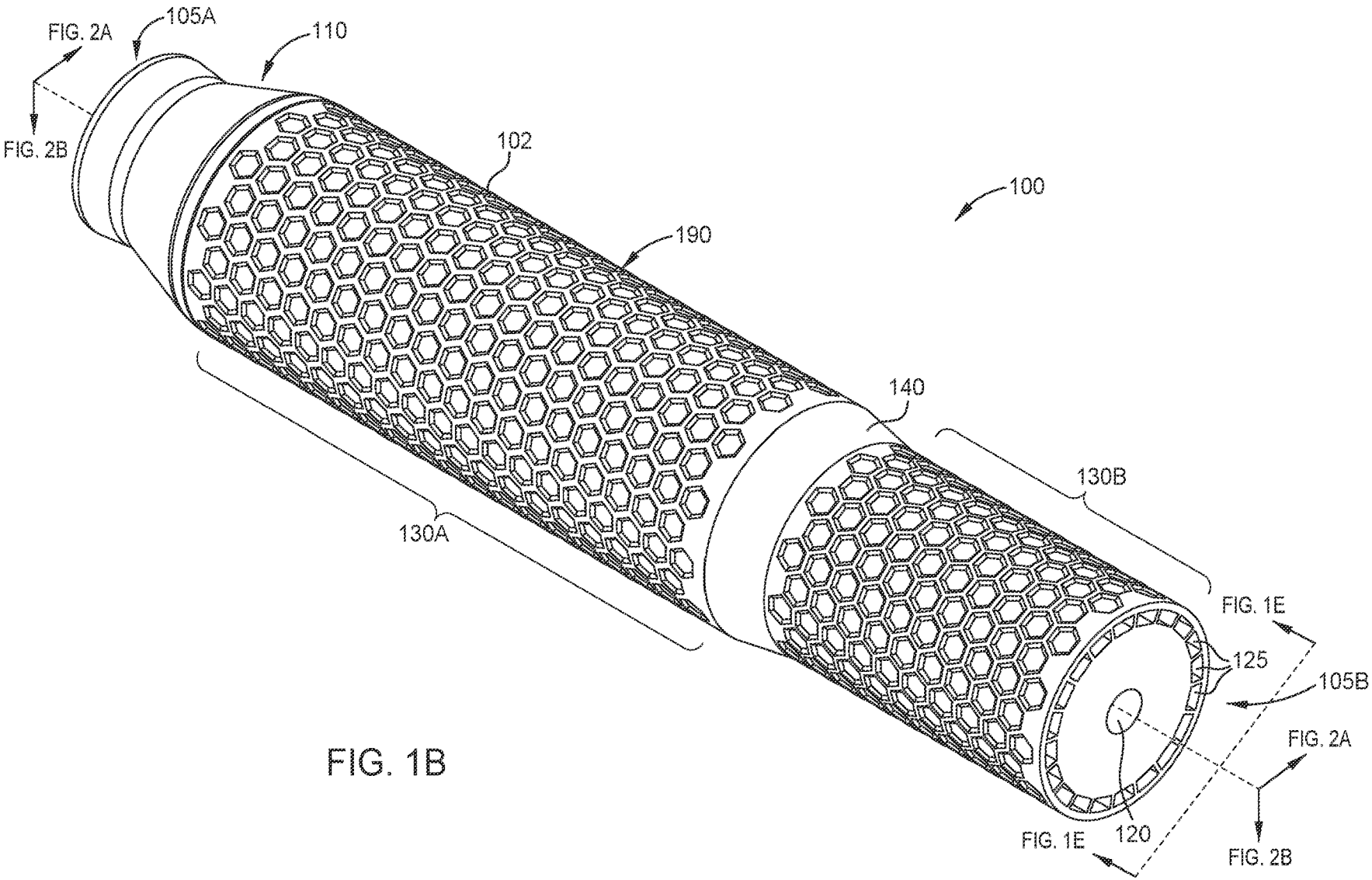
FIG. 1B is an isometric rear view of the suppressor of FIG. 1A.
Figure 1C:
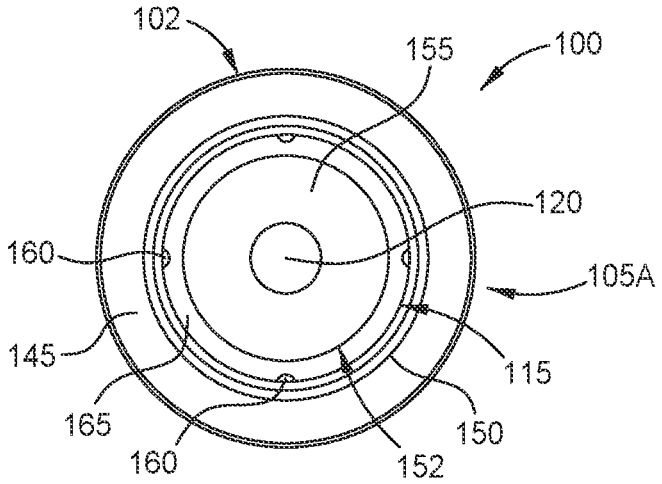
FIG. 1D is a partial sectional view of the suppressor along lines 1D-1D of FIG. 1A.
FIG. 1E is a rear view of the suppressor along lines 1E-1E of FIG. 1B.

FIG. 1A is an isometric front view of a suppressor 100 according to one embodiment. FIG. 1B is an isometric rear view of the suppressor 100 of FIG. 1A.

The suppressor 100 includes an elongated body 102 having a muzzle end 105A and a breech end 105B opposite to the muzzle end 105A. The muzzle end 105A includes a cone shaped nozzle 110 that is external to the body 102. The cone shaped nozzle 110 extends from the body 102 housing or circumscribing a muzzle chamber 115. The cone shaped nozzle 110 resembles a truncated cone. The cone shaped nozzle 110 and the muzzle chamber 115 forms part a venturi nozzle that is an integral part of the suppressor 100.

As shown in FIG. 1B, the breech end 105B includes an opening 120 that defines a portion of internal bore extending through the body 102. At least a portion of the opening 120 at the breech end 105B includes threads for coupling with a barrel of a firearm (not shown). When coupled to a firearm, a projectile exiting the barrel enters the opening 120 and passes through the body 102, exiting out of the muzzle end 105A.

The breech end 105B also includes a plurality of cooling channels 125 that extend through the body 102. The cooling channels 125 are in fluid communication with ambient air at the breech end 105B and extend through the body 102 to the muzzle chamber 115.

In some embodiments, the body 102 includes a first section 130A and a second section 130B. The first section 130A includes a first diameter 135A and the second section 130B include a second diameter 135B. The first diameter 135A is greater than the second diameter 135B. The reduced second diameter 135B of the second section 130B is utilized to allow the suppressor 100 to fit within a handguard (not shown) that is typically utilized on conventional firearms. The enlarged first diameter 135A of the first section 130A is provided to maximize an internal volume of the body 102. A transition region 140 is provided as an interface between the first section 130A and the second section 130B. In some embodiments, the enlarged first diameter 135A provides additional internal volume for internal channels 160 (shown and described in FIGS. 10, 1D, 2A and 2B below).

The cone shaped nozzle 110 includes an inwardly angled outer sidewall 145 transitioning from the first diameter 135A to an annular ring section 150. The annular ring section 150 includes a diameter (i.e., third diameter 135C) that is less than both of the first diameter 135A and the second diameter 135B. Thus, the geometry of the cone shaped nozzle 110 provides a constriction for air and/or hot gases as a projectile exits the muzzle end 105A of the suppressor 100.

As will be explained in more detail below, the operation of the suppressor 100 is as follows. When a projectile is fired through the suppressor 100 and passes through the muzzle end 105A of the suppressor 100, a high-pressure atmosphere and shock wave is created inside the muzzle chamber 115 of the cone shaped nozzle 110. This high pressure inside the muzzle and the low pressure outside causes a Venturi-effect which pulls ambient air from the breech end 105B through the flow channels 125 and the body 102. The ambient air passes over and/or through portions of the body 102 removing heat from the body 102. The heated air then exits into the muzzle chamber 115 and out of the muzzle end 105A of the suppressor 100.

In one example, a Venturi-effect created by the construction of the suppressor 100 causes fluid flow velocity to increase as it passes through a constriction provided by the geometry of the cone shaped nozzle 110 (i.e., the third diameter 135C), while the fluid's static pressure is decreased. Since the fluid molecules are flowing faster in the constriction, the pressure in the constriction should be lower than it is outside of the constriction. In order for the fluid molecules to speed up as they enter the constriction, and then slow down again as they leave, there must be a pressure difference at the entrance and exit of the constriction. When the velocity of the fluid increases, the fluid moves from higher pressure to lower pressure regions. As the fluid flows horizontally, the highest speed occurs where the pressure is the lowest. The low-pressure ambient air at the muzzle end 105A of the suppressor 100 is moved into the channels 125 and rapidly across and/or through the body 102 thus cooling the suppressor, reducing thermal signature, and extending operational life.

In some embodiments, as shown in FIGS. 1A and 1B, the suppressor 100 includes a coating 190 disposed on the outer surface of the body 102. The coating 190 effectively manages the visual and near-infrared (NIR) signature while at the same time enhancing thermal protection and durability. The coating 190 is applied to the suppressor 100 and allowed to cure until the coating 190 reaches its desired hardness and chemical properties. The coating 190 has a Wolff-Wilbourn (Pencil Hardness) test rating (ASTM D3363) of 9h+, the highest hardness rating. Once cured the coating 190 has no odor, is RoHS and REACH compliant, and conforms to NIR reflectivity standards outlined in MIL-DTL-44436. In some embodiments, the coating 190 includes a plurality of polygonal structures 195 having a plurality if raised sides 196. The polygonal structures 195 may be hexagonal as shown, or shaped as pentagons, rectangles or triangles. The polygonal structures 195 increase the surface area of the body 102, which enhances heat transfer.

Under extreme temperatures, the coating 190 has been observed to change colors, as if to burn away (e.g., during extreme torture testing). However, upon cooling, the coating 190 restores to its original color and leaves no indication, as determined through outwardly visual or thermal/IR observations, of any deterioration of its protective or thermal/IR mitigating properties. The coating 190 retains effective thermal/IR mitigating properties even at elevated temperatures. Other coatings that were tested would deteriorate over time thus reducing their effectiveness. The coating 190 can also be mixed in any color combination desired for any application.

Figure 1D:
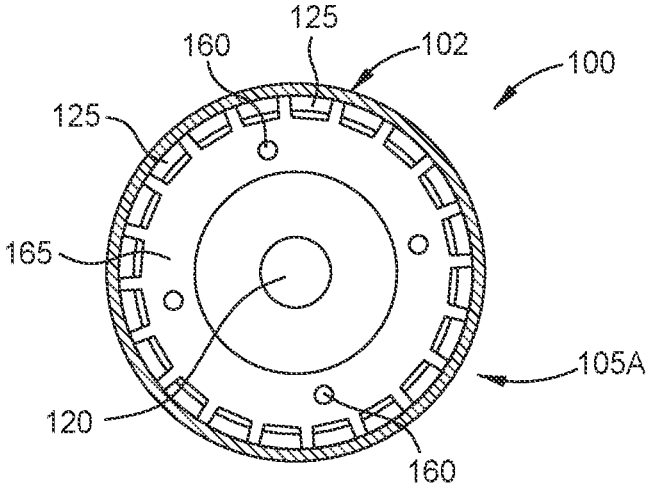
Figure 1E:
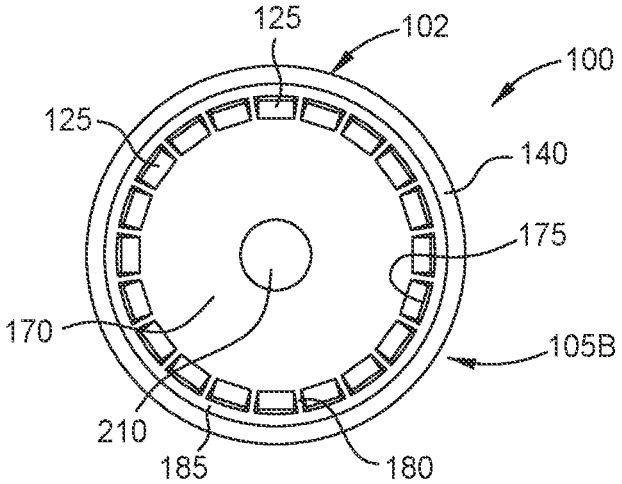

FIGS. 10-1E are various views of the suppressor 100. FIG. 10 is a front view of the suppressor 100 along lines 10-10 of FIG. 1A (the muzzle end 105A). FIG. 1D is a partial sectional view of the suppressor 100 along lines 1D-1D of FIG. 1A. FIG. 1E is a rear view of the suppressor 100 along lines 1E-1E of FIG. 1B (the breech end 105B).

As shown in FIGS. 10 and 1D, the suppressor 100 includes a venturi nozzle 152 (or muzzle chamber 115) formed at least in part by a volume defined by interior surfaces of the cone shaped nozzle 110 and a conical wall 155 inside the muzzle chamber 115. The conical wall 155 and the venturi nozzle 152 will be shown and described in more detail below.

The suppressor 100 also includes a plurality of internal channels 160 that are formed radially and/or longitudinally (lengthwise) inward of the cooling channels 125. Each of the internal channels 160 are formed in a faceplate 165 of the body 102 and/or the muzzle chamber 115. While each of the cooling channels 125 extend from the breech end 105B of the suppressor 100 to the muzzle chamber 115, each of the internal channels 160 are in fluid communication with the opening 120 inside the body 102 (near the transition region 140 of FIGS. 1A and 1B) and are open to the muzzle chamber 115 at the muzzle end 105A. The internal channels 160 function to minimize over-pressurization of internal regions of the body 102 and will be explained in greater detail below. Each of the plurality of cooling channels 125 and the plurality of internal channels 160 terminate in the faceplate 165.

As shown in FIG. 1E, the plurality of cooling channels 125 are shown in a breech face 170 of the body 102. Each of the cooling channels 125 include an internal surface 175 and are separated by a radially oriented wall 180. Each of the walls 180 are coupled to an outer ring 185. In use, the cooling channels 125 are an effective heat sink. For example, when a projectile is fired through the suppressor 100, the internal surfaces 175, the walls 180 and the outer ring 185 conduct heat. However, ambient air from the breech end 105B flows along the internal surfaces 175, the walls 180 and the outer ring 185 (based on the Venturi-effect described above) and heat is removed from the body 102.

Figure 2A:
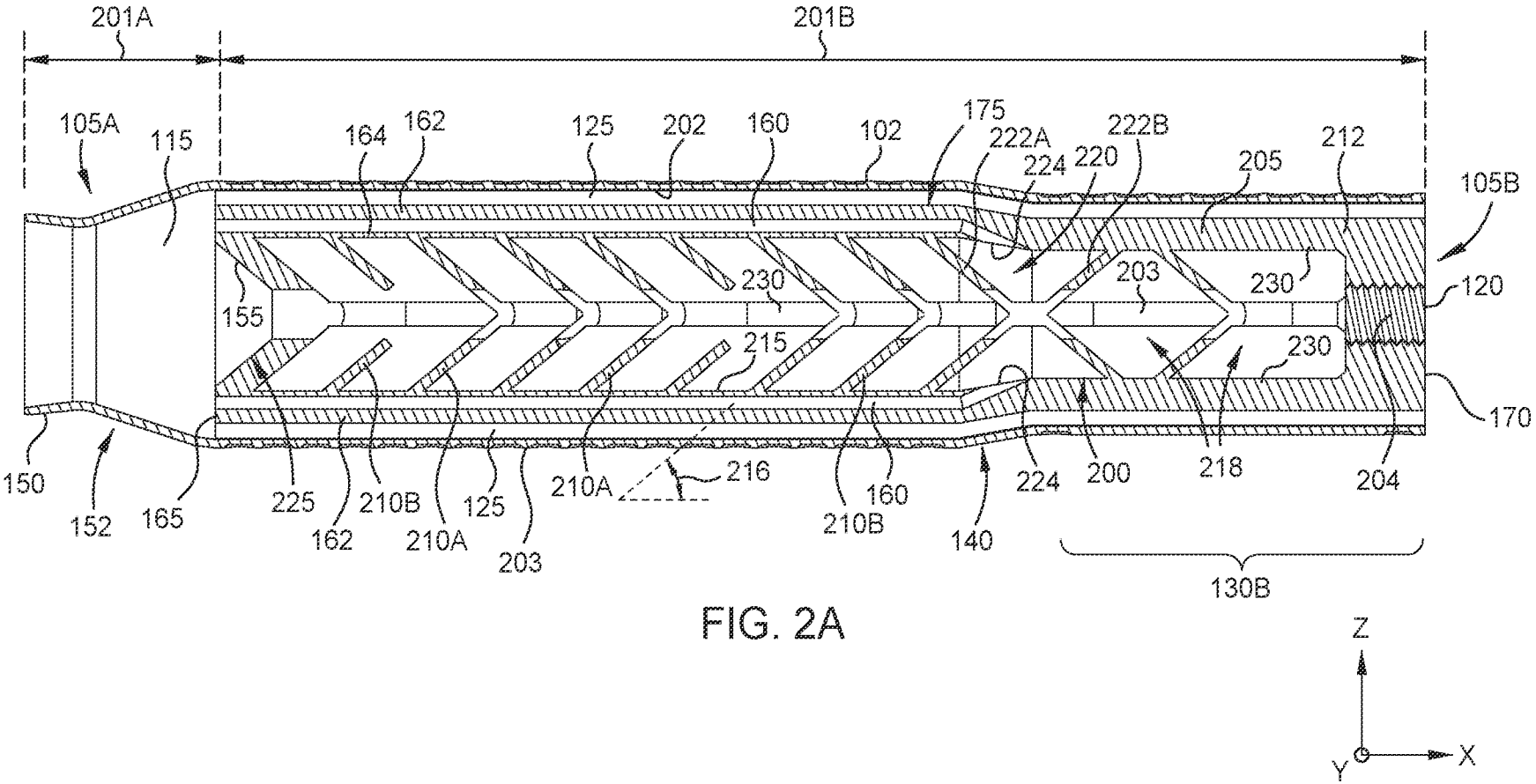
FIGS. 2A and 2B are sectional side views of the suppressor along lines 2A-2A and 2B-2B of FIG. 1B, respectively.
Figure 2B:
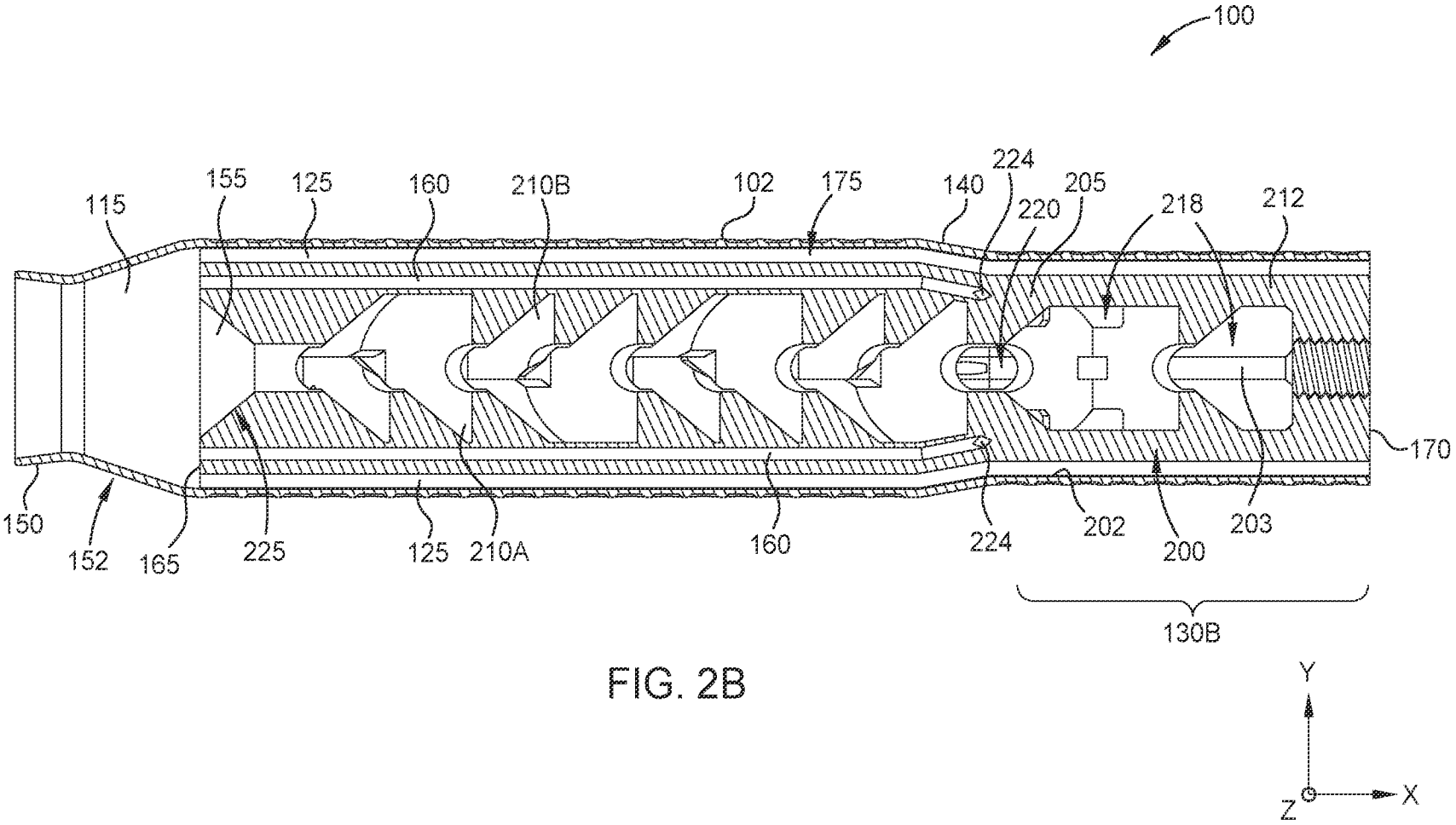

FIGS. 2A and 2B are sectional side views of the suppressor 100 along lines 2A-2A and 2B-2B of FIG. 1B, respectively. The internal channels 160 and the cooling channels 125 are clearly shown in both of FIGS. 2A and 2B. An internal volume 200 of the suppressor 100 is shown in both of FIGS. 2A and 2B. The plurality of cooling channels 125 are radially separated from the plurality of internal channels 160 by an outer longitudinal wall 162 (shown in FIG. 2A) that is part of a primary structural frame 205. The plurality of internal channels 160 are at least partially separated from the internal volume 200 by an inner longitudinal wall 164 (shown in FIG. 2A) that is part of the structural frame 205.

In one embodiment, the suppressor 100 includes a first portion 201A and a second portion 201B. The first portion 201A includes the venturi nozzle 152 (as well as the muzzle chamber 115) and the second portion 201B includes the remainder of the body 102 of the suppressor 100 (specifically including the internal volume 200). In some embodiments, a ratio of the empty volume of the internal volume 200 (i.e., between a cover layer 202 surrounding an inner periphery of the body 102 and adjacent to any solid portions within the inside surface of the cover layer 202) to the volume of the muzzle chamber 115 is about 85%:15%. The term "about" in this context means+/−3%. In some embodiments, such as for an M-240 firearm, the internal volume 200 is about 16 cubic inches to about 18 cubic inches, for example about 17.5 cubic inches. In contrast, the volume of the venturi nozzle 152 (or muzzle chamber 115) is about 2.8 cubic inches to about 3.2 cubic inches, for example about 3 cubic inches. The term "about" in this context means+/−0.2 cubic inches. Thus, a ratio of the volume of the internal volume 200 relative to the volume of the muzzle chamber 115 is 5.8:1 in some embodiments. In other embodiments, such as for an M-249 firearm, the volumes described above may be reduced by 15%.

A central bore 203, sized to allow a projectile to pass therethrough, is shown along a length of the body 102. Threads 204 are shown in the opening 120 of the breech face 170 for coupling with a barrel of a firearm (not shown).

The internal volume 200 includes the primary structural frame 205 providing a majority of the rigidity of the body 102. The structural frame 205 includes a varying cross-section along a length of the body 102. The structural frame 205 includes a plurality of baffles shown as full baffles 210A and partial baffles 210B. Each of the full baffles 210A and the partial baffles 210B extend from an internal surface 215 of the internal volume 200 at an angle 216 relative to horizontal (e.g., the Y-X plane). The angle 216 is substantially orthogonal (e.g., 45 degrees+/−5 degrees). The full baffles 210A and the partial baffles 210B differ in length (the partial baffles 210B having a length less than a length of the full baffles 210A). In some embodiments, the partial baffles 210B are provided in order to increase the volume of the internal volume 200. Additionally or alternatively, the partial baffles 210B serve to disrupt gas flow within the internal volume 200, which aids in reducing sound levels of the suppressor 100.

A portion of the structural frame 205 within the second section 130B of the body 102 comprises a heat sink 212. The heat sink 212, generally located at the breech end 1306 where temperatures may be the greatest during firing of a projectile, absorbs at least a portion of the thermal energy from the firing of the projectile via conduction, convection and/or radiation. The heat sink 212 then transfers the thermal energy to ambient air via the cooling channels 125 using the Venturi-effect from the venturi nozzle 152 (or muzzle chamber 115) when a projectile is fired.

The internal volume 200 also includes one or more expansion chambers 218 located at the breech end 105B of the body 102. The expansion chambers 218 at least partially contain the initial blast of hot and/or expanding gases when a projectile is fired into the suppressor 100. The expansion chambers 218 lead to a blast chamber 220 downstream of the expansion chambers 218. The blast chamber 220 is bounded by a pair of first baffles 222A and a pair of second baffles 222B. The first baffles 222A and the second baffles 222B are full baffles 210A. The first baffles 222A and the second baffles 222B differ in the angular and/or directional orientation in the internal volume 200 relative to the internal surface 215 and/or the body 102. The first baffles 222A are oriented rearward (toward the breech end 105B) similar to other full baffles 210A (and partial baffles 210B). The second baffles 222B are oriented frontward at an angle opposite to the angle 216 (toward the muzzle end 105A). However, the angle of the second baffles 222B may be the same as the angle 216.

As mentioned above, as the internal channels 160 are inside the body 102, and a length of the internal channels 160 are less than a length of the cooling channels 125. The internal channels 160 may be referred to as "redirect nozzles". Each of the internal channels 160 have an inlet or port 224 that is positioned adjacent to, and/or is in fluid communication with, the blast chamber 220. As a projectile is fired, the blast chamber 220 fills with high pressure/high heat gasses. When the gasses reach the blast chamber 220, a portion of the gasses are redirected through the ports 224. This allows a portion of the gasses to pass into the internal channels 160. By allowing gasses to free flow out of the internal volume 200, blast chamber 220, ports 224 and the internal channels 160, back pressures are significantly decreased while having less of an impact of the cyclic rate of the host weapon which reduces wear. Redirecting blast chamber gasses allows the highest temperature and pressure gasses to move unimpeded directly into the nozzle area, avoiding any disruption and minimizing heat loss. By redirecting the gasses directly into the nozzle from the blast chamber, the heat and high pressure increases the atmospheric pressure inside the muzzle chamber 115 of the cone shaped nozzle 110. The redirect nozzles (e.g., the internal channels 160) increase air speed over the cooling channels 125 by approximately 40%.

The internal volume 200 ends in a brake 225 formed in the body 102. The brake 225 is integral to the body 102 of the suppressor 100. The brake 225 includes the conical wall 155 and forms a portion of the venturi nozzle 152. In some embodiments, the brake 225 is utilized to redirect a portion of the propellant gases from a fired projectile to counter recoil in the firearm and/or "muzzle rise" which may interfere with accuracy of the firearm. Additionally or alternatively, the brake 225 redirects sound forward (toward the muzzle end 105A), away from the shooter of the firearm.

The structural frame 205 also includes a structural support member 230. The structural support member 230 generally spans a length of the body 102 within the internal volume 200. A portion of the structural support member 230 is the baffles (i.e., the full baffles 210A and the partial baffles 210B).

Thermal Heat Transfer of the Suppressor

The suppressor 100 was tested for thermal heat transfer through stress testing and super heating the suppressor 100 to about 1550 degrees F. through a sustained fire regimes (two cycles) of 600 rounds of 147 gr 7.62×51 NATO ball ammunition. Temperature was measured at 60 second intervals during sustained fire over the two cycles using a Fluke® Infrared Thermometer Model 572-2 having a maximum operating temperature of 1652 degrees F. Ambient temperature of the suppressor 100 subsequent to firing was recorded at 144 degrees F. Results of the testing is shown in Table 1.

TABLE 1

| Cycle | Minute | Temp | Cycle | Minute | Temp |
|---|---|---|---|---|---|
| 1 | 1 | 1565 | 2 | 1 | 1505 |
| | 2 | 1305 | | 2 | 1226 |
| | 3 | 1110 | | 3 | 1036 |
| | 4 | 938 | | 4 | 875 |
| | 5 | 820 | | 5 | 793 |
| | 6 | 750 | | 6 | 700 |
| | 7 | 647 | | 7 | 617 |
| | 8 | 581 | | 8 | 560 |
| | 9 | 522 | | 9 | 501 |
| | 10 | 484 | | 10 | 440 |
| | 11 | 441 | | 11 | 407 |
| | 12 | 403 | | 12 | 374 |
| | 13 | 373 | | 13 | 343 |
| | 14 | 344 | | 14 | 322 |
| | 15 | 315 | | 15 | 296 |
| | 16 | 295 | | 16 | 274 |
| | 17 | 275 | | 17 | 256 |
| | 18 | 252 | | 18 | 247 |
| | 19 | 244 | | 19 | 235 |
| | 20 | 227 | | 20 | 226 |
| | 21 | 212 | | 21 | 212 |
| | 22 | 206 | | 22 | 206 |
| | 23 | 195 | | 23 | 193 |
| | 24 | 188 | | 24 | 180 |
| | 25 | 182 | | 25 | 170 |
| | 26 | 171 | | 26 | 164 |
| | 27 | 161 | | 27 | 160 |
| | 28 | 152 | | 28 | 153 |
| | 29 | 145 | | 29 | 145 |
| | 30 | 144 | | 30 | 141 |

As shown above in the first cycle, a peak temperature of 1565 degrees F. was recorded upon completion of 600 rounds of sustained fire. At 10 minutes post firing, a temperature of 484 degrees F. was recorded, which indicated a drop of 1081 degrees F. At 20 minutes post firing, a temperature of 227 degrees F. was recorded, which indicated a drop of 1338 degrees F. After 30 minutes, the suppressor 100 had a temperature of 144 degrees F., which indicates a drop of 1421 degrees F.

In conjunction with Texas A&M University, College Station, Tex., Aeronautical Engineering department, an air volume test was conducted on the suppressor 100 for air speed and volume passing over the heat sink 212 and/or the cooling channels 125, which facilitates cooling the suppressor 100. The air speed and volume testing were performed using a HoldPeak® HP-866B anemometer coupled to the breech end 130B of the suppressor 100 via a 2.6" circular duct. Multiple 25 round cycles were fired in full-automatic mode and peak wind speed was determined in MPH.

Tested wind speed showed sustained 15.4 MPH through the suppressor 100. Using an air flow calculation through the 2.6" circular duct, a calculated 49.97 cubic feet/minute (CFM) is achieved through the cooling channels 125 of the suppressor 100 each time a projectile is fired. For perspective, a restroom exhaust fan creates 50 CFM of air flow. This enhanced air flow through the cooling channels 125 along the heat sink 212 is achieved using no moving mechanical parts in or on the suppressor 100.

Accuracy and Velocity

Accuracy and velocity of a host weapon using the suppressor 100 was tested using single round rate of fire through a chronograph.

Unsuppressed velocity resulted in 2809 FPS (maximum) and 2760 FPS (minimum). Using the same host weapon with the suppressor 100 as described herein resulted in 2796 FPS (maximum) and 2746 FPS (minimum). Velocity showed no negative impact using the suppressor 100 as described herein.

Accuracy was tested using single rounds in five round groups with each round loaded individually. The test host weapon used was full-automatic fire only, causing the feed tray to be lifted each round. Five cycles of five rounds were performed suppressed and unsuppressed. Due to lifting the feed tray, optics 'zero' was compromised between shots, so the average of five cycles was used to determine minute of angle (MOA) variation. The suppressor 100 as described herein averaged 0.5 MOA to 1.0 MOA better than unsuppressed.

Extreme Torture Testing

Extreme torture testing was conducted using 600 round belts of full-automatic sustained fire, allowing cooling to ambient between firing schedules. Upon cooling, internal and external conditions were observed for any degradation and overall serviceability. External inspection was performed visually and internal inspection was performed using a borescope and endosnake digital camera. Temperature ranged per cycle between 1450-1550 degrees F. at peak temperatures. Upon completion of 6 cycles of 600 rounds of full automatic sustained fire, no indications of internal or external excessive wear or damage was recorded.

Sound Reduction

The effective sound reduction was tested with an M-240 machine gun (host weapon) using a Larsen Davis LXT1-QPR firearms sound meter and was measured in decibels (dB). Baseline was determined using the Mil-Spec muzzle device provided with the M-240. Prior to testing, the sound meter was calibrated at 112 dB and ambient sound was measured to be 102 dB at the testing facility. The sound meter and muzzle were placed at 5 feet 2 inches from the ground using tripod stands. The sound meter was placed 6.56 feet left in line with the muzzle ("dB left" below) for one test and near the shooter's ear ("dB at shooters ear" below) for another test. The M-240 had the dB readings shown in Table 2.

TABLE 2

| Unsuppressed dB Left (baseline) | Suppressed dB Left |
|---|---|
| High: 159.8<br>Low: 158.9<br>Avg: 159.4 | High: 137.9<br>Low: 135.5<br>Avg: 137 |
| **Unsuppressed dB at Shooters Ear (baseline)** | **Suppressed dB at Shooters Ear** |
| High: 154.5<br>Low: 153.7<br>Avg: 153.9 | High: 138<br>Low: 135.4<br>Avg: 136.3 |

While the foregoing is directed to examples of the present disclosure, other and further examples of the disclosure may be devised without departing from the basic scope thereof, and the scope thereof is determined by the claims that follow.

What is claimed is:

1. A suppressor, comprising:

a unitary structure comprising a body having an interior volume and a cone shaped nozzle disposed at one end of the body, wherein the body has a breech end opposite a faceplate and includes a plurality of cooling channels spanning a length of the body, and a plurality of internal channels is disposed radially inward of the cooling channels, both the plurality of cooling channels and the plurality of internal channels terminating at the faceplate of the body, and each of the cooling channels has a first opening at the breech end and a second opening at the faceplate, and wherein the unitary structure further comprises:

an outer ring spanning from the breech end to at least the faceplate;

a longitudinal wall spanning from the breech end to the faceplate, wherein the longitudinal wall is disposed radially inward of the outer ring; and a plurality of radially oriented walls extending between the longitudinal wall and the outer ring, wherein the plurality of cooling channels is disposed between the longitudinal wall, the outer ring, and the radially oriented walls;

a central bore extending from the breech end of the body to the faceplate; and a plurality of baffles surrounding the central bore.

2. The suppressor of claim 1, wherein the body includes a first section having a first diameter and a second section having a second diameter that is less than the first diameter.

3. The suppressor of claim 1, wherein each of the plurality of cooling channels are separated from each of the plurality of internal channels by the longitudinal wall.

4. The suppressor of claim 1, wherein the cone shaped nozzle includes a muzzle chamber at a muzzle end of the unitary structure.

5. The suppressor of claim 4, wherein the unitary structure incudes a first portion including the muzzle chamber and a second portion including the interior volume, and a volumetric ratio of the interior volume relative to the muzzle chamber is about 85%:15%.

6. The suppressor of claim 1, wherein a first portion of the plurality of baffles extends from an internal surface of the body and terminate near the central bore, and a second portion of the plurality of baffles extends from the internal surface and terminate at a position that is spaced apart from the central bore.

7. The suppressor of claim 1, wherein a portion of the plurality of baffles defines a blast chamber.

8. The suppressor of claim 7, wherein the blast chamber is bounded by a first baffle and a second baffle of the plurality of baffles, and the first baffle extends in a direction that is opposite to an extending direction of the second baffle.

9. The suppressor of claim 1, wherein the cone shaped nose extends from the faceplate to a muzzle end of the unitary structure.

10. A suppressor, comprising:

a unitary structure comprising a body having an interior volume and a cone shaped nozzle disposed at one end of the body, wherein the body has a breech end opposite a faceplate and includes a plurality of cooling channels spanning a length of the body, and a plurality of internal channels is disposed radially inward of the cooling channels, both the plurality of cooling channels and the plurality of internal channels terminating at the faceplate of the body, and each of the cooling channels has a first opening at the breech end and a second opening at the faceplate, and wherein the unitary structure further comprises:

an outer ring spanning from the breech end to at least the faceplate; and a longitudinal wall spanning from the breech end to the faceplate, wherein the longitudinal wall is disposed radially inward of the outer ring, and wherein the plurality of cooling channels is disposed between the longitudinal wall and the outer ring;

a central bore extending from the breech end of the body to the faceplate; and a plurality of baffles surrounding the central bore, wherein a portion of the plurality of baffles defines a blast chamber downstream of an expansion chamber, and wherein the blast chamber is bounded by a first baffle and a second baffle of the plurality of baffles.

11. The suppressor of claim 10, wherein the first baffle extends in a direction that is opposite to an extending direction of the second baffle.

12. The suppressor of claim 10, wherein each of the plurality of internal channels is in fluid communication with the blast chamber.

13. The suppressor of claim 10, wherein the body includes a first section having a first diameter and a second section having a second diameter that is less than the first diameter.

14. The suppressor of claim 10, wherein the plurality of cooling channels is separated from the plurality of internal channels by the longitudinal wall.

15. The suppressor of claim 10, wherein the unitary structure further comprises a plurality of radially oriented walls extending between the longitudinal wall and the outer ring, wherein the plurality of cooling channels is disposed between the longitudinal wall, the outer ring, and the radially oriented walls.

16. The suppressor of claim 10, wherein the cone shaped nose extends from the faceplate to a muzzle end of the unitary structure.

17. A suppressor, comprising:

a unitary structure comprising a body having an interior volume and a cone shaped nozzle disposed at one end of the body, wherein the body has a breech end opposite a faceplate and includes a plurality of cooling channels spanning a length of the body, and a plurality of internal channels is disposed radially inward of the cooling channels, both the plurality of cooling channels and the plurality of internal channels terminating at the faceplate of the body, and each of the cooling channels has a first opening at the breech end and a second opening at the faceplate, wherein the cone shaped nozzle includes a muzzle chamber at a muzzle end of the unitary structure, and wherein the unitary structure incudes a first portion including the muzzle chamber and a second portion including the interior volume, and a volumetric ratio of the interior volume relative to the muzzle chamber is about 85%:15%, and wherein the unitary structure further comprises:

an outer ring spanning from the breech end to at least the faceplate; and a longitudinal wall spanning from the breech end to the faceplate, wherein the longitudinal wall is disposed radially inward of the outer ring, and wherein the plurality of cooling channels is disposed between the longitudinal wall and the outer ring;

a central bore extending from the breech end of the body to the faceplate; and a plurality of baffles surrounding the central bore, wherein a portion of the plurality of baffles defines a blast chamber bounded by a first baffle and a second baffle of the plurality of baffles.

18. The suppressor of claim 17, wherein the body includes a first section having a first diameter and a second section having a second diameter that is less than the first diameter.

19. The suppressor of claim 17, wherein the plurality of cooling channels is separated from the plurality of internal channels by the longitudinal wall.

20. The suppressor of claim 17, wherein the first baffle extends in a direction that is opposite to an extending direction of the second baffle.

21. The suppressor of claim 17, wherein each of the plurality of internal channels are in fluid communication with the blast chamber.

22. The suppressor of claim 17, wherein the unitary structure further comprises a plurality of radially oriented walls extending between the longitudinal wall and the outer ring, wherein the plurality of cooling channels is disposed between the longitudinal wall, the outer ring, and the radially oriented walls.

23. The suppressor of claim 17, wherein the cone shaped nose extends from the faceplate to the muzzle end of the unitary structure.

* * * * *